United States Patent [19]

Marchesini

[11] Patent Number: 4,810,421

[45] Date of Patent: Mar. 7, 1989

[54] LIQUID CLEANER WITH ORGANIC SOLVENT AND TERNARY BUILDER MIXTURE

[75] Inventor: Maurizio Marchesini, Brusells, Belgium

[73] Assignee: The Procter & Gamble Company, Cincinnati, Ohio

[21] Appl. No.: 31,078

[22] Filed: Mar. 26, 1987

[30] Foreign Application Priority Data

Apr. 3, 1986 [GB] United Kingdom ..... 8608148

[51] Int. Cl.[4] ..... C11D 3/33; C11D 3/43

[52] U.S. Cl. ..... 252/546; 252/153; 252/154; 252/155; 252/156; 252/164; 252/174.19; 252/DIG. 14; 252/171

[58] Field of Search ..... 252/546, 174.19, DIG. 11

[56] References Cited

U.S. PATENT DOCUMENTS

| | | | |
|---|---|---|---|
| 3,702,303 | 11/1972 | Clemens et al. | 252/163 |
| 3,832,309 | 8/1974 | Foster et al. | 252/527 |
| 3,956,164 | 5/1976 | Walker et al. | 252/180 |
| 4,082,683 | 4/1978 | Galesloot | 252/105 |
| 4,276,185 | 6/1981 | Martin | 252/87 |
| 4,414,128 | 11/1983 | Goffinet | 252/111 |
| 4,529,450 | 7/1985 | Panayappan | 134/4 |
| 4,530,781 | 7/1985 | Gipp | 252/546 |
| 4,595,527 | 6/1986 | Gipp | 252/546 |
| 4,676,920 | 6/1987 | Culshaw | 252/163 |

FOREIGN PATENT DOCUMENTS

| | | |
|---|---|---|
| 0137474 | 10/1984 | European Pat. Off. . |
| 171122 | 8/1986 | European Pat. Off. . |
| 0171122 | 8/1986 | European Pat. Off. . |

*Primary Examiner*—Prince E. Willis

*Attorney, Agent, or Firm*—Leonard Williamson; Richard C. Witte

[57] ABSTRACT

Cleaners with excellent shine quality are prepared from mixtures of organic solvent and a builder comprising a ternary mixture of citrate/NTA/EDTA.

10 Claims, No Drawings

LIQUID CLEANER WITH ORGANIC SOLVENT AND TERNARY BUILDER MIXTURE

TECHNICAL FIELD

Liquid hard surface cleaners with excellent cleaning and shine properties are prepared using organic solvents and a ternary builder mixture.

BACKGROUND

It is well-known to use, separately, various solvents, surfactants and "builders" (generally, metal ion chelators) in liquid hard surface cleaners to promote the cleaning function.

However, equally important to the user of such products is their "shine" quality, i.e., the absence of filming or streaking on surfaces such as glass, stainless steel, mirrors, and the like. Most users tend to equate good cleaning with shine, but this is a mistake. Unfortunately, many cleaning ingredients leave unsightly, streaky deposits on surfaces.

The present invention provides liquid cleaners that are characterized not only by their excellent cleaning properties, but also by their high shine quality. The compositions herein are particularly suited for cleaning glass, metal (including automobiles), ceramic, high-gloss paint, porcelain, and the like, surfaces where shine quality is important to the user. The compositions are safe for use on plastics.

SUMMARY OF THE INVENTION

The compositions herein comprise:

(a) at least 2% of a ternary builder which comprises a mixture of citrate, nitrilotriacetate (NTA) and ethylenediaminetetraacetate (EDTA) chelators;

(b) at least 2% of an organic solvent; and (c) the balance of the composition comprising water as the carrier liquid, and optionally containing detersive surfactants, pH-adjusting agents, hydrotropes, and the like, all as described more fully hereinafter.

Preferred compositions according to this invention comprise from 2% to 9.5%, especially 2% to 7%, of said ternary builder, and 2% to 10% of said solvents.

Preferred compositions from the standpoint of good shine performance are those wherein the amount of citrate is greater than the combined amounts of nitrilotriacetate and ethylenediaminetetraacetate.

Preferred solvents herein are the Carbitol (especially Butyl Carbitol at a concentration of at least 3%) or Cellosolve solvents, or 2-ethyl-1,3-hexanediol or 2,2,4-trimethyl-1,3-pentanediol, or mixtures or said diol solvents with Carbitols or Cellosolves.

The compositions herein are typically formulated at pH 8–11, and are preferably free of phosphates.

Also preferred are compositions which contain less than 1% nonionic surfactant; again, to help maintain shine performance.

The compositions herein may optionally contain an abrasive.

All percentages and proportions herein are be weight, unless otherwise specified.

DETAILED DESCRIPTION OF THE INVENTION

The compositions herein are formulated to minimize, or preferably, to be substantially free, of many ingredients commonly disclosed for use in hard surface cleaners. For example, materials such as the common "builder" phosphates are preferably not used herein because they decrease shine quality. Likewise, nonionic surfactants are kept to a minimum, and the compositions use anionic surfactants at rather low levels (0.1%–10%), generally 0.75%–2%.

Solvent

The solvents employed herein can be any of the well-known "degreasing" solvents commonly used in, for example, the drycleaning industry, in the hard-surface cleaner industry and the metalworking industry. Many such solvents comprise hydrocarbon or halogenated hydrocarbon moieties of the alkyl or cycloalkyl type, and have a boiling point well above room temperature.

The formulator of compositions of the present type will be guided in the selection of solvent partly by the need to provide good grease-cutting properties, and partly by aesthetic considerations. For example, kerosene hydrocarbons function well in the present compositions, but can be malodorous. Kerosene can be used in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease-removal properties and have a low, pleasant odor. Likewise, the olefin solvents having a boiling point of at last about 100° C., especially alpha-olefins, perferably 1-decene or 1-dodecene, are excellent grease-removal solvents.

The combination of the aforesaid alkyl-aromatic or olefin solvents with polar liquids such as n-hexanol, Butyl Carbitol (Trade Mark) or hte phthalic acid esters constitute additional examples of mixed non-polar/polar solvents that can be used in the practice of this invention.

2-Ethyl-1, 3-hexanediol and 2,2,4-trimethyl-1,3-pentanediol are each highly preferred solvents for use herein, and are preferably used in combination with a "CARBITOL" (Trade Mark), or "CELLOSOLVE" (Trade Mark) solvent.

The Carbitol solvents are of the 2-(2-alkoxyethoxy) ethanol class, and the Cellosolves are of the 2-alkoxyethanol class. The Cellosolves are, generally, a little less soluble in water than the Carbitols, but they can be solubilized using hydrotropes. Preferred for use herein is Butyl Carbitol (Trade Mark for 2-(2-butoxyethoxy) ethanol).

The carbitol and cellosolve solvents preferably comprise at least 2%, generally 2%–10%, most preferably at least 3% Butyl Carbitol, of the present compositions. The 2-ethyl-1,3-hexanediol or 2,2,4-trimethyl-1,3-pentanediol solvent also preferably comprises at least 2%, generally 2%–10%, of the compositions. While most preferably used in combination, these carbitol and diol solvents may be used singly, according to the needs of the formulator of the present compositions.

The compositions herein also preferably contain a water-soluble anionic surfactant, especially the $C_{10}$–$C_{18}$ paraffin sulfonates and the $C_{10}$–$C_{14}$ alkylbenzene sulfonates, with the former being preferred with the ternary builder herein.

As mentioned, nonionic surfactants may be used in modest amounts, but the levels are generally kept below 1%, generally about 0.5–0.6%. Nonionics can decrease shine performance, and since they are primarily used for greasy soil removal—a function which the solvents perform exceptionally well—the typical $C_9$–$C_{18}$ EO 3–7 ethoxylated alcohol or alkylphenol nonionic surfactants are kept to a minimum.

The compositions herein are formulated at a pH in the range 8–11, preferably 9–10.7. Materials such as sodium hydroxide, sodium carbonate, and the like, can be used to adjust pH.

Builder

Apart from the solvent, the other key ingredients in the present compositions are the chelators which comprise the ternary builder. These chelators can be used in any acid or water-soluble salt form, such as the sodium, potassium, or other soluble alkali metal or ammonium salt forms, or mixtures thereof. The preferred components of the ternary builder are each in their water-soluble sodium salt form, i.e., sodium citrate, sodium NTA and sodium EDTA.

In particular, the citrate builder appears to co-act in some way with organic solvents and the other two builders herein to provide exceptionally high shine quality in a manner not shown by other materials. The reason for this unique performance is not understood.

The compositions herein can contain various colorants, bactericides, perfumes, suds control agents, and the like. Generally, usage levels of such optional ingredients are in the range of 0.02% to 1%.

The compositions herein are preferably formulated as homogeneous liquids, so a hydrotrope (1%–5%) may be used to ensure homogeneity. Sodium cumene sulfonate is a preferred hydrotrope, but hydrotropes such as the toluene and xylene sulfonates may also be used, according to the desires of the formulator.

In an alternate mode, the compositions may be formulated as abrasive-containing products, including liquids, creams and pastes.

INDUSTRIAL APPLICATION.

Example I is a non-limiting example of a highly preferred liquid hard surface cleaner of the type encompassed by the present invention and formulated within the range of most highly preferred compositions of the general type:

| | |
|---|---|
| (i) Trisodium citrate | 1%–5% |
| (ii) Trisodium nitrilotriacetate | 0.5%–3% |
| (iii) Tetrasodium ethylenediaminetetraacetate | 0.5%–1.5% |
| (iv a) 2-Ethyl-1,3-Hexanediol, or | 2%–5% |
| (iv b) 2,2,4-Trimethyl-1,3-pentanediol | 2%–5% |
| (v) Butyl Carbitol | 2%–5% |
| (vi) Anionic Surfactant | 0.75%–2% |
| (vii) Hydrotrope | 1%–5% |
| (vi) Water and Minors | Balance |
| pH (product undiluted) | 10–11 |

EXAMPLE I

| Ingredients | Percent by Weight |
|---|---|
| Sodium paraffin sulfonate | 1.50 |
| Ethoxyalcohol ($C_{13-15}$-3AE) | 0.60 |
| Hardened coconut fatty acid | 0.10 |
| Hydrogenated fatty acid | 0.10 |
| $Na_3$—citrate | 3.00 |
| $Na_3$—NTA | 1.00 |
| $Na_4$—EDTA | 0.90 |
| $Na_2CO_3$ | 2.00 |

-continued

| Ingredients | Percent by Weight |
|---|---|
| Butyl Carbitol | 3.00 |
| 2-Ethyl-1,3-hexanediol | 3.20 |
| Na—Cumene sulfonate | 1.80 |
| Perfume | 0.66 |
| Water and minors | balance. |

The composition of Example I is prepared by mixing the indicated ingredients. The resulting composition gives excellent results in both hard surface cleaning and shine. The composition may be used "as is", or may be diluted in water, according to the desires of the user.

The compositions herein may also be formulated to contain an abrasive. Typical abrasives include water-insoluble powdered materials such as talc, calcium carbonate, pumice, melamine-urea-formaldehyde resin, polyethylene spheres, methacrylate resin, polyvinylchloride, and the like. Typically, abrasives have a particle size range of 10–1000 microns and are used at concentrations of 10% to 30% in the compositions. Thickeners may be added to suspend the abrasives.

EXAMPLE II

An abrasive cleaner is prepared by adding 15% by weight of commercial calcium carbonate (particle diameter below 200 microns) to the composition of Example I, and thickening the composition with a mixture of carboxymethyl cellulose and Veegum to provide a pasty, mildly abrasive cleanser.

EXAMPLE III

A bath tub and hard surface liquid cleaner is as follows:

| Ingredients | Percent by Weight |
|---|---|
| $C_{12-16}$ Paraffin sulfonate | 1.0 |
| Triethanolamine | 3.0 |
| Hexyl carbitol | 3.0 |
| Sodium citrate | 5.0 |
| Sodium nitrilotriacetate | 0.5 |
| Sodium EDTA | 0.5 |
| Sodium cumene sulfonate | 3.0 |
| Water/NaOH to pH 10.0 | Balance |

In use, the composition is applied directly to the tub surface, rubbed briskly, and rinsed.

I claim:

1. A hard surface cleaner in liquid or paste form, comprising at least 2% of a ternary builder which comprises a mixture of citrate, nitrilotriacetate and ethylenediaminetetraacetate chelators, and at least 2% of an organic solvent, wherein said citrate is present at a level of from 1% to 5%, and said nitrilotriacetate is present at a level of from 0.5% to 3%, and said ethylenediaminetetraacetate chelator is present at a level of from 0.5% to 1.5%, and wherein said hard surface cleaner provides an excellent shine to the hard surface cleaned therewith.

2. A composition according to claim 1 which comprises from 2% to 9.5% of said ternary builder.

3. A composition according to claim 1 wherein the solvent comprises a Carbitol or a Cellosolve solvent, or 2-ethyl-1,3-hexanediol or 2,2,4-trimethyl-1,3-pentanediol, or mixtures thereof.

4. A composition according to claim 2 which contains at least 3% Butyl Carbitol.

5. A composition according to claim 1 which is formulated at pH 8–11.

6. A composition according to claim 1 which is substantially free of phosphates.

7. A composition according to claim 1 which contains less than 1% nonionic surfactant.

8. A composition according to claim 1 which contains an abrasive.

9. A composition according to claim 1 wherein the amount of citrate is greater than the combined amounts of nitrilotriacetate and ethylenediaminetetraacetate.

10. A hard surface cleaner in liquid or paste form, at least 2% of a ternary builder which comprises a mixture of citrate, nitrilotriacetate and ethylenediaminetetraacetate chelators, and at least 2% of an organic solvent, wherein said citrate is present at a level of from 1% to 5%, and said nitrilotriacetate is present at a level of from 0.5% to 3%, and said ethylenediaminetetraacetate chelator is present at a level of from 0.5% to 1.5%, and wherein said solvent is selected from the group consisting of carbitol, cellosole solvent 2-ethyl-1,3-hexanediol and 2,2,4-trimethyl-1, 3-pentanediol and mixtures thereof, and wherein said hard surface cleaner provides an excellent shine to the hard surface cleaned therewith.

* * * * *